US010166449B2

(12) United States Patent
Yarmuth

(10) Patent No.: US 10,166,449 B2
(45) **Date of Patent: *Jan. 1, 2019**

(54) COMBINED GOLF CLUB HEAD COVER AND STAND

(71) Applicant: PutterUp, LLC, Louisville, KY (US)

(72) Inventor: Aaron Yarmuth, Louisville, KY (US)

(73) Assignee: PutterUp, LLC, Louisville, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/622,823

(22) Filed: Jun. 14, 2017

(65) Prior Publication Data

US 2017/0282033 A1 Oct. 5, 2017

Related U.S. Application Data

(63) Continuation of application No. 14/920,393, filed on Oct. 22, 2015, now abandoned, which is a continuation of application No. 14/526,098, filed on Oct. 28, 2014, now Pat. No. 9,192,834.

(60) Provisional application No. 61/900,761, filed on Nov. 6, 2013.

(51) Int. Cl.
*A63B 55/10* (2006.01)
*A63B 60/62* (2015.01)

(52) U.S. Cl.
CPC ..... *A63B 60/62* (2015.10); *A63B 55/10* (2013.01)

(58) Field of Classification Search
CPC ..... A63B 60/62; A63B 55/10; A63B 55/00
See application file for complete search history.

(56) References Cited

U.S. PATENT DOCUMENTS 3,988,797 A * 11/1976 Tornero ..... A43B 3/16 12/142 RS
4,030,213 A * 6/1977 Daswick ..... A43B 5/06 36/103
5,282,622 A * 2/1994 Evans ..... A63B 69/3685 473/243
D408,205 S * 4/1999 Davis ..... D21/735
6,634,956 B1 * 10/2003 Pegg ..... A63B 53/007 473/251
D571,423 S * 6/2008 Cameron ..... D21/754
7,494,422 B2 * 2/2009 Pegg ..... A63B 53/007 473/292

(Continued)

FOREIGN PATENT DOCUMENTS

CA 2298113 A1 * 8/2001

*Primary Examiner* — Stephen Blau
(74) *Attorney, Agent, or Firm* — Stites & Harbison, PLLC; David W. Nagle, Jr.; James R. Hayne

(57) ABSTRACT

A combined golf club cover and stand comprises a substantially rigid base and a cover portion configured to securely hold a head of a golf club against the substantially rigid base. The substantially rigid base includes a bottom platform, a first side wall, and an opposing second side wall with a bottom ledge that extends toward the first side wall, such that when the head of the golf club is held against the substantially rigid base, a toe end of the head is in contact with an interior surface of the first side wall, and a heel end of the head sits on the bottom ledge of the second side wall. The assembled golf club and combined golf club cover and stand is thus capable of standing upright, without any outside support, when the bottom platform is on a substantially flat underlying ground surface.

11 Claims, 4 Drawing Sheets

(56) References Cited

U.S. PATENT DOCUMENTS

| | | | | |
|---|---|---|---|---|
| 7,828,145 | B2 * | 11/2010 | Grander | A45F 3/04 206/315.1 |
| D661,358 | S * | 6/2012 | Szabo | D21/754 |
| 8,276,627 | B2 * | 10/2012 | Gaffney | A63B 60/62 150/154 |

* cited by examiner

COMBINED GOLF CLUB HEAD COVER AND STAND

CROSS-REFERENCE TO RELATED APPLICATIONS

The present application is a continuation of U.S. patent application Ser. No. 14/920,393 filed on Oct. 22, 2015, which is a continuation of U.S. patent application Ser. No. 14/526,098 filed on Oct. 28, 2014 (now U.S. Pat. No. 9,192,834), which claims priority to U.S. Provisional Patent Application Ser. No. 61/900,761 filed on Nov. 6, 2013, the entire disclosures of which are incorporated herein by reference.

BACKGROUND OF THE INVENTION

Golf is an extremely popular sport for players of all ages. Oftentimes, a player will set a golf club, such as a putter, on the ground temporarily to perform a variety of tasks where holding the golf club would be difficult. The player must then bend over to pick up the golf club off of the ground. Some people may have difficulty playing golf because they are unable to bend over to pick up golf clubs laying on the ground. There are golf club stands available which allow a user to store a golf club in an upright position; however, these stands are large and heavy. Thus, the user of these stands is either not moving very far (such as at a driving range) or must walk a great distance from the stand to where the golf ball is lying (such as a golf bag attached to a golf cart).

Thus, there remains a need for a stand that is portable and will keep a golf club, such as a putter, in an upright position.

SUMMARY OF THE INVENTION

The present invention is a combined golf club cover and stand which is highly portable and maintains a golf club, such as a putter, in an upright position. The combined golf club cover and stand is not much larger than the head of the golf club and is not heavy. The head of the golf club is placed inside of the combined golf club cover and stand, and, through the unique structure of the combined golf club cover and stand, the golf club is positioned so that it will stand in an upright position. In some embodiments, the combined golf club cover and stand also includes other features, such as a flexible cover and closable flap, which help ensure that the golf club does not accidentally shift while inside the combined golf club cover and stand.

DETAILED DESCRIPTION OF THE INVENTION

Figure 1:
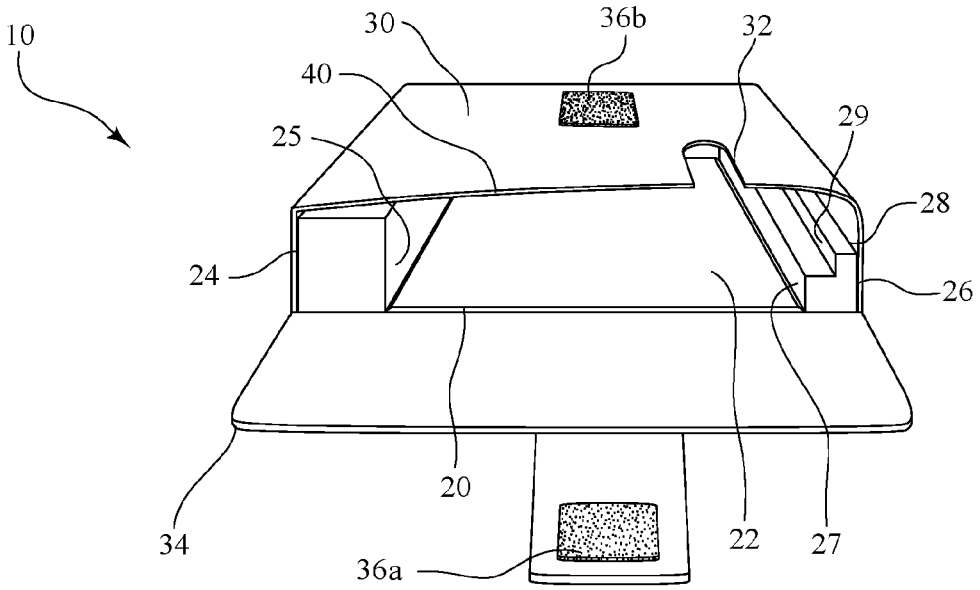
FIG. 1 is a perspective view of an exemplary combined golf club cover and stand made in accordance with the present invention.

FIG. 1 is a perspective view of an exemplary combined golf club cover and stand 10 made in accordance with the present invention. The exemplary combined golf club cover and stand 10 includes a substantially rigid base 20, which has a bottom platform 22, a first side wall 24, and an opposing second side wall 26. The first side wall 24 defines a substantially flat interior surface 25 for engaging one side of the head of a golf club, as further described below. The second side wall 26 has a generally L-shaped cross section, including a bottom ledge 27 and an upward extending lip 28 that defines an interior surface 29, the importance of which is also described below.

The combined golf club cover and stand 10 also includes a cover portion 30 which spans at least from the first side wall 24 to the second side wall 26, with the substantially rigid base 20 and the cover portion 30 collectively defining an internal cavity. In this exemplary embodiment, the cover portion 30 also effectively defines a rear wall, such that there is only one open end 40 into the internal cavity. Furthermore, in this exemplary embodiment, the cover portion 30 also extends under the substantially rigid base 20; thus, the cover portion 30 may be characterized as a sleeve with the one open end 40.

In some embodiments, the cover portion 30 is a substantially flexible, fabric material. However, the cover portion 30 could also be made from a semi-rigid or rigid material without departing from the spirit and scope of the present invention. In any event, in this exemplary embodiment and as shown in FIG. 1, the cover portion 30 also defines a slot 32, the importance of which is further described below.

Figure 2:
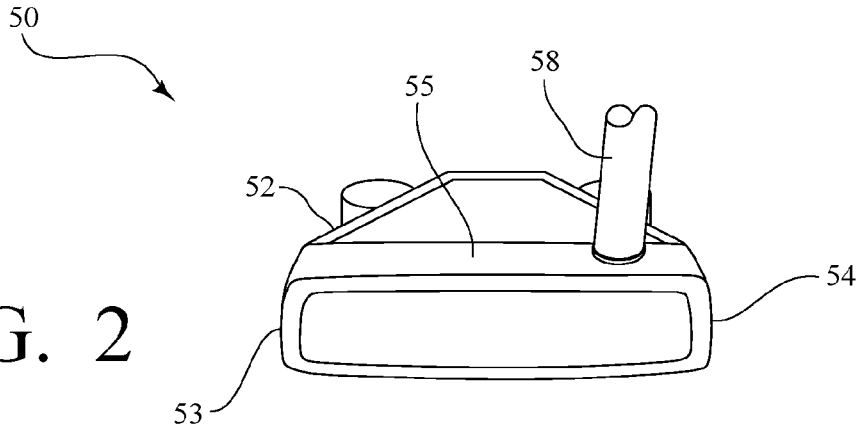
FIG. 2 is a partial perspective view of a golf club for use with the exemplary combined golf club cover and stand of FIG. 1.

FIG. 2 is a partial perspective view of a golf club 50 for use with the combined golf club cover and stand 10 of FIG. 1. The golf club 50 includes a head 52 which has a top 55, a toe end 53, and a heel end 54. The golf club 50 also includes a shaft 58 which extends from the top 55 of the head 52 near the heel end 54 of the head 52. In some embodiments, the shaft 58 extends from the top 55 of the head 52 at an angle relative to the top 55 of the head 52. In other embodiments, the shaft 58 may extend perpendicularly to the top 55 of the head 52 for a short distance, after which the shaft 58 is at an angle relative to the top 55 of the head 52. In any case, when the golf club 50 is viewed in its entirety, the shaft 58 is not oriented perpendicular to the head 52 of the golf club 50. Thus, if a user attempted to stand the golf club 50 in an upright position (i.e., resting the head 52 of the golf club 50 on the ground with the shaft 58 extending upward away from the ground), the golf club 50 would immediately tip over.

Figure 3:
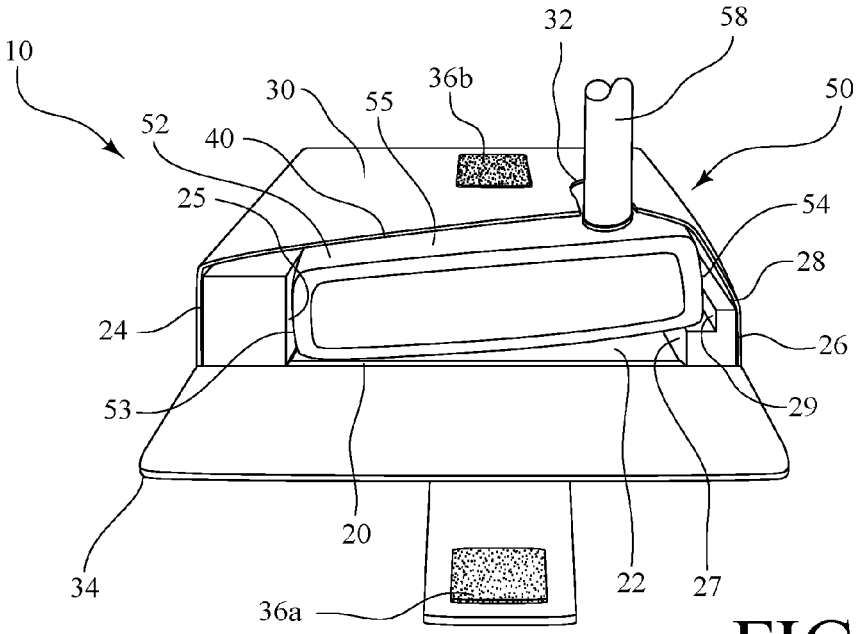
FIG. 3 is a perspective view showing the interaction of the exemplary combined golf club cover and stand of FIG. 1 with the golf club of FIG. 2.

FIG. 3 is a perspective view showing the interaction of the exemplary combined golf club cover and stand 10 of FIG. 1 with the golf club 50 of FIG. 2. As shown, the head 52 of the golf club 50 is received through the open end 40 of the golf club cover and stand 10 and into the internal cavity defined by the combined golf club cover and stand 10. In this way, the cover portion 30 acts as a securing mechanism that firmly holds the head 52 of the golf club 50 against the substantially rigid base 20. The slot 32 in the cover portion 30 is configured to accept the shaft 58 of the golf club 50, allowing the cover portion 30 to maintain contact with substantially all of the top 55 of the head 52 of the golf club 50. When the golf club 50 is firmly held against the substantially rigid base 20, the toe end 53 of the head 52 sits on the bottom platform 22 and is in contact with the interior surface 25 defined by the first side wall 24. Furthermore, the heel end 54 of the head 52 sits on the bottom ledge 27 of the second side wall 26 and is in contact with the interior surface 29 defined by the lip 28.

Without wishing to be bound by theory or mechanism, it is believed that to function properly, the center of mass of the assembled golf club 50 and combined golf club cover and stand 10 must be located above the substantially rigid base 20, and ideally directly above the center of the substantially rigid base 20. By raising the heel end 54 of the head 52 of the golf club 50 off of the bottom platform 22, the head 52 of the golf club 50 is oriented at an angle relative to the underlying ground surface that allows the golf club 50 to stand upright without any outside support. The dimensions of the second side wall 26 are chosen to allow the golf club 50 to stand upright, without any outside support, when the bottom platform 22 is on a substantially flat underlying ground surface. Specifically, the height of the bottom ledge 27 of the second side wall 26, along with the distance that the bottom ledge 27 of the second side wall 26 extends toward the first side wall 24, affects the ultimate angle of the shaft 58 of the golf club 50 relative to the underlying ground surface when the golf club 50 is received in the combined golf club cover and stand 10. For example, as shown in FIGS. 3 and 4, when the golf club 50 is received in the combined golf club cover and stand 10, the shaft 58 of the golf club 50 is held in a substantially vertical orientation as compared to the orientation of the shaft 58 of the golf club 50 without the combined golf club cover and stand 10, as shown in FIG. 2.

Figure 4:
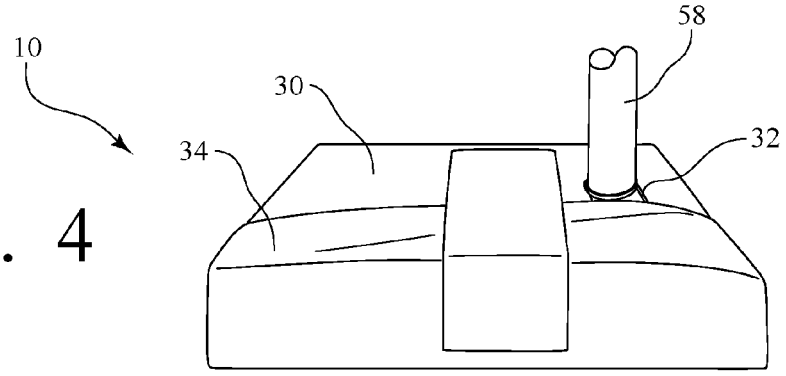
FIG. 4 is a perspective view similar to FIG. 3, but with the closable flap in a closed position.

Referring now to FIGS. 1, 3, and 4, in this exemplary embodiment, the combined golf club cover and stand 10 also includes a closable flap 34. The closable flap 34 extends from a lower portion of the cover portion (i.e., below the bottom platform 22) and extends across the open end 40 of the combined golf club cover and stand 10. When the closable flap 34 extends across the open end 40, the closable flap 34 completely covers the open end 40, such that, the head 52 of the golf club 50 is surrounded by and closed entirely within the combined golf club cover and stand 10, thereby minimizing the movement of the golf club 50 in relation to the combined golf club cover and stand 10. The closable flap 34 also allows a user to transport the golf club 50 in the combined golf club cover and stand 10 without worrying about the combined golf club cover and stand 10 falling off of the golf club 50. In this regard, the closable flap 34 preferably has a closing mechanism which is used to temporarily affix the closable flap 34 to the top of the cover portion 30. In this exemplary embodiment, a first hook and loop fastener portion 36*a* is attached to the closable flap 34, and a corresponding second hook and loop fastener portion 36*b* is attached to the cover portion 30. Although the closing mechanism shown in this exemplary embodiment comprises hook and loop fasteners, it is contemplated that snaps, buttons, magnetic attachments, or any other temporary closing mechanisms could be used without departing from the spirit and scope of the present invention.

Figure 5:
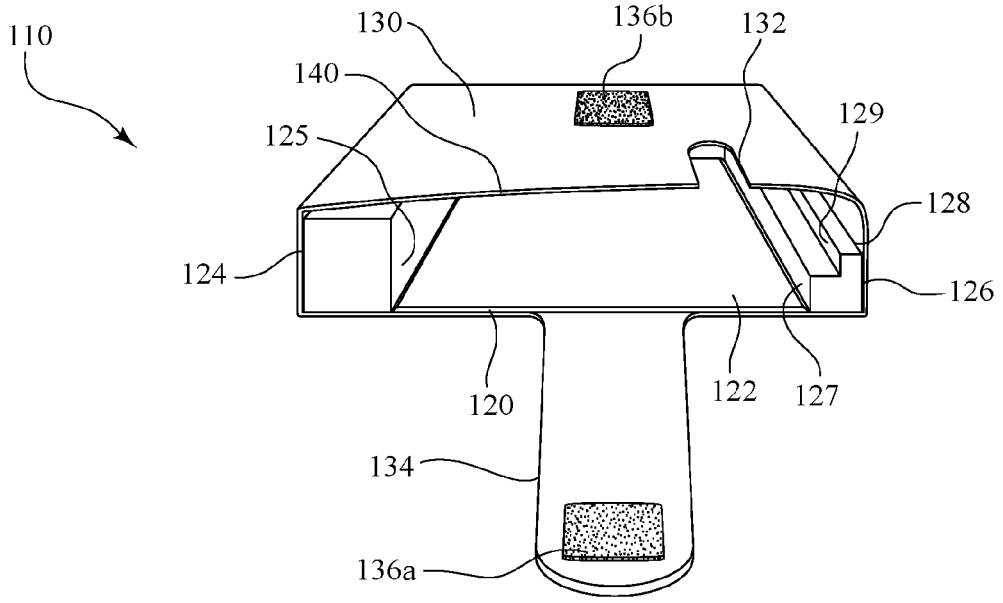
FIG. 5 is a perspective view of another exemplary combined golf club cover and stand made in accordance with the present invention.
Figure 6:
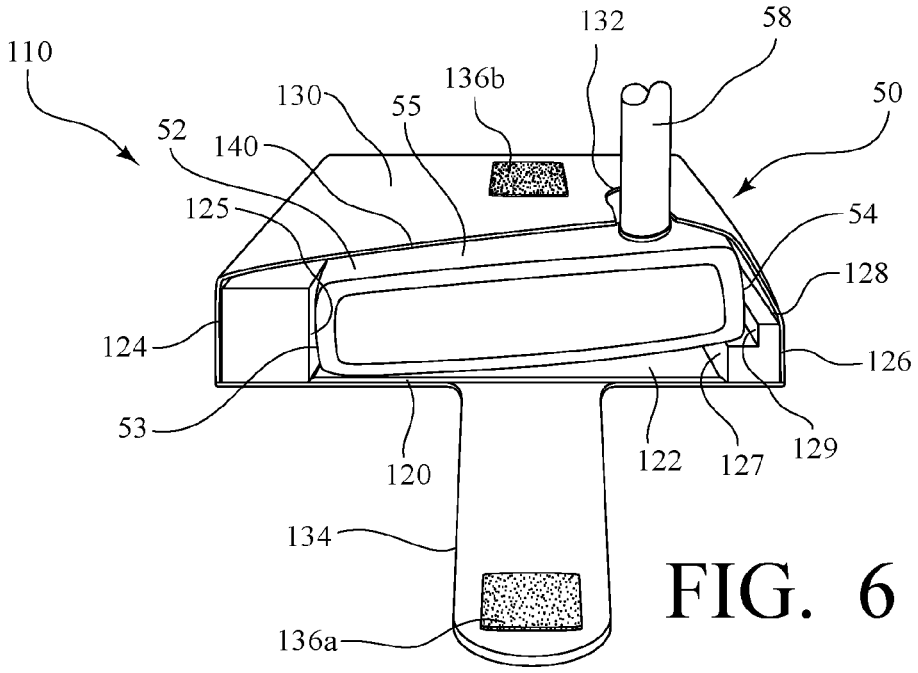
FIG. 6 is a perspective view showing the interaction of the exemplary combined golf club cover and stand of FIG. 5 with the golf club of FIG. 2.
Figure 7:
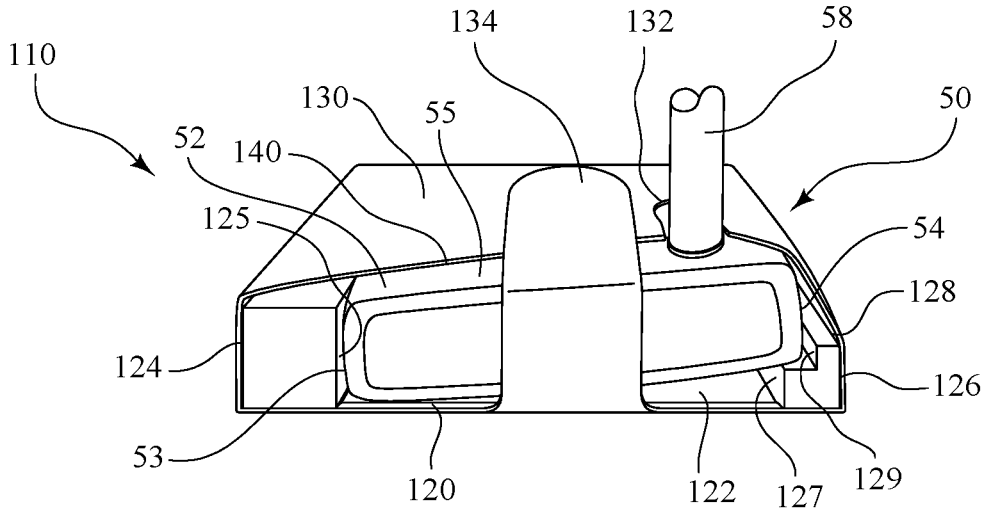
FIG. 7 is a perspective view similar to FIG. 5, but with the closable flap in a closed position.

FIGS. 5-7 are views of another exemplary combined golf club cover and stand 110 made in accordance with the present invention. The exemplary combined golf club cover and stand 110 again includes a substantially rigid base 120, which has a bottom platform 122, a first side wall 124, and an opposing second side wall 126. The first side wall 124 defines a substantially flat interior surface 125 for engaging one side of the head of a golf club. The second side wall 126 has a generally L-shaped cross section, including a bottom ledge 127 and an upward extending lip 128 that defines an interior surface 129.

The combined golf club cover and stand 110 also includes a cover portion 130 which spans at least from the first side wall 124 to the second side wall 126, with the substantially rigid base 120 and the cover portion 130 collectively defining an internal cavity. In this exemplary embodiment, the cover portion 130 also effectively defines a rear wall, such that there is only one open end 140 into the internal cavity. Furthermore, in this exemplary embodiment, the cover portion 130 also extends under the substantially rigid base 120; thus, the cover portion 130 may be characterized as a sleeve with the one open end 140. Finally, the cover portion 130 defines a slot 132. Thus, with respect to the above-described components and features, the exemplary combined golf club cover and stand 110 is identical to that described above with reference to FIGS. 1, 3, and 4.

As shown in FIG. 6, when the head 52 of the golf club 50 (FIG. 2) is received through the open end 140 of the combined golf club cover and stand 110, the toe end 53 of the head 52 sits on the bottom platform 122 and is in contact with the interior surface 125 defined by the first side wall 124, and the heel end 54 of the head 52 sits on the bottom ledge 127 of the second side wall 126 and is in contact with the interior surface 129 defined by the lip 128. Thus, the interaction of the exemplary combined golf club cover and stand 110 with the golf club 50 is identical to that described above with respect to the exemplary combined golf club cover and stand 10 and with reference to FIG. 3.

However, unlike the exemplary combined golf club cover and stand 10 described above with reference to FIGS. 1, 3, and 4, this combined golf club cover and stand 110 includes a closable flap 134 in the form of a strap that extends from a lower portion of the cover portion 130 (i.e., below the bottom platform 122) and extends across the open end 140 of the combined golf club cover and stand 110. The combined golf club cover and stand 110 also includes a first hook and loop fastener portion 136*a* attached to the closable flap 134 and a corresponding second hook and loop fastener portion 136*b* attached to the cover portion 130 to temporarily affix the closable flap 134 to the top of the cover portion 130. Thus, as shown in FIG. 7, in this exemplary embodiment, the closable flap 134 does not completely cover the open end 140; however, the closable flap 134 still functions to hold the head 52 of the golf club 50 securely within the internal cavity of the combined golf club cover and stand 110, thereby minimizing the movement of the golf club 50 in relation to the combined golf club cover and stand 110.

One of ordinary skill in the art will recognize that additional embodiments and configurations are also possible without departing from the teachings of the present invention or the scope of the claims which follow. This description, and particularly the specific details of the exemplary embodiments disclosed, is given primarily for clarity of understanding, and no unnecessary limitations are to be understood therefrom, for modifications will become obvious to those skilled in the art upon reading this disclosure and may be made without departing from the spirit or scope of the claimed invention.

What is claimed is:

1. A combined golf club cover and stand, comprising:

a substantially rigid base with a bottom platform; and a cover portion which, in combination with the substantially rigid base, defines an internal cavity with an open end for receiving a head of a golf club;

wherein the substantially rigid base further includes a first side wall and an opposing second side wall, wherein the second side wall includes a bottom ledge that extends toward the first side wall;

wherein the cover portion spans from the first side wall to the second side wall; and wherein, in use, when the head of the golf club is received in the internal cavity, the head of the golf club is held against the substantially rigid base, with a toe end of the head of the golf club in contact with an interior surface defined by the first side wall and a heel end of the head the golf club sitting on the bottom ledge of the second side wall, such that, when the bottom platform of the combined golf club cover and stand is on a substantially flat underlying ground surface, the heel end of the head is oriented at an angle relative to an underlying ground surface, and the golf club will stand upright.

2. The combined golf club cover and stand of claim 1, wherein the second side wall further comprises a lip that extends upward from the bottom ledge of the second side wall wherein, in use, when the head of the golf club is held against the substantially rigid base, the heel end of the head of the golf club is in contact with an interior surface defined by the lip.

3. The combined golf club cover and stand of claim 1, wherein the cover portion defines a slot configured to accept a shaft of the golf club.

4. The combined golf club cover and stand of claim 1, wherein the cover portion is made of a substantially flexible material.

5. The combined golf club cover and stand of claim 1, wherein the cover portion is made of a fabric.

6. A combined golf club cover and stand, comprising:

a substantially rigid base with a bottom platform;

a cover portion which, in combination with the substantially rigid base, defines an internal cavity with an open end for receiving a head of a golf club; and a closable flap that is configured to extend across the open end of the cover portion;

wherein, in use, the head of the golf club is received in the internal cavity, such that, when the bottom platform of the combined golf club cover and stand is on a substantially flat underlying ground surface, a heel end of the head is oriented at an angle relative to an underlying ground surface, and the golf club will stand upright.

7. The combined golf club cover and stand of claim 6, wherein the closable flap includes a closing mechanism configured to temporarily affix the closable flap to a top of the cover portion when the closable flap extends across the open end.

8. The combined golf club cover and stand of claim 7, wherein the closing mechanism comprises a first hook and loop fastener portion attached to the closable flap and a second hook and loop fastener portion attached to the top of the cover portion.

9. The combined golf club cover and stand of claim 6, wherein the cover portion defines a slot configured to accept a shaft of the golf club.

10. The combined golf club cover and stand of claim 6, wherein the cover portion is made of a substantially flexible material.

11. The combined golf club cover and stand of claim 6, wherein the cover portion is made of a fabric.

* * * * *